US011473401B2

(12) United States Patent
Wang et al.

(10) Patent No.: US 11,473,401 B2
(45) Date of Patent: Oct. 18, 2022

(54) METHOD FOR CONTROLLING TOE-END SLIDING SLEEVE OF HORIZONTAL WELL BASED ON EFFICIENT DECODING COMMUNICATION

(71) Applicant: University of Electronic Science and Technology of China, Chengdu (CN)

(72) Inventors: Hua Wang, Chengdu (CN); Xingming Wang, Chengdu (CN); Yukun Fu, Chengdu (CN)

(73) Assignee: UNIVERSITY OF ELECTRONIC SCIENCE AND TECHNOLOGY OF CHINA, Chengdu (CN)

( * ) Notice: Subject to any disclaimer, the term of this patent is extended or adjusted under 35 U.S.C. 154(b) by 0 days.

(21) Appl. No.: 17/169,204

(22) Filed: Feb. 5, 2021

(65) Prior Publication Data

US 2021/0238955 A1 Aug. 5, 2021

(30) Foreign Application Priority Data

Feb. 5, 2020 (CN) ..... 2020100806954
Jun. 9, 2020 (CN) ..... 2020105183856

(51) Int. Cl.
*E21B 34/14* (2006.01)
*E21B 47/06* (2012.01)
(Continued)

(52) U.S. Cl.
CPC ..... *E21B 34/08* (2013.01); *E21B 34/16* (2013.01); *E21B 47/06* (2013.01); *E21B 43/2607* (2020.05); *E21B 2200/06* (2020.05)

(58) Field of Classification Search
CPC ..... E21B 34/14; E21B 47/06; E21B 2200/06
See application file for complete search history.

(56) References Cited

U.S. PATENT DOCUMENTS 6,536,529 B1 * 3/2003 Kerr ..... E21B 47/18 166/375
9,416,643 B2 * 8/2016 Purkis ..... E21B 43/26
(Continued)

FOREIGN PATENT DOCUMENTS

CN 202755959 U 2/2013
CN 207999237 U 10/2018
(Continued)

*Primary Examiner* — Kenneth L Thompson
(74) *Attorney, Agent, or Firm* — Muncy, Geissler, Olds & Lowe, P.C.

(57) ABSTRACT

The present invention discloses a method for controlling a toe-end sliding sleeve in a horizontal well based on efficient decoding communication. The method comprises the following steps: forming a pressure wave signal by adjusting and controlling a pressure value in a wellbore according to a first preset encoding manner; acquiring a pressure value change signal in the wellbore, determining a reference time by using an STA/LTA method, and predicting pressure value to acquire a predicted pressure value signal curve; identifying a toe-end sliding sleeve control command in the acquired pressure wave signal by using a first preset decoding manner based on the fitness between the acquired pressure value signal curve and the predicted pressure value signal curve; and driving the toe-end sliding sleeve to perform actions according to the toe-end sliding sleeve control command. The method disclosed by the present invention is simple to operate, low in communication error rate, and aimed to solve the technical problems of complicated system of wellbore pressure test and sliding sleeve joint operation, high operation complexity, high bit error rate of pressure pulse communication, and long code element transmission time in the existing solutions in the prior art.

9 Claims, 8 Drawing Sheets

(51) Int. Cl.

| | |
|---|---|
| ***E21B 34/08*** | (2006.01) |
| ***E21B 34/16*** | (2006.01) |
| *E21B 43/26* | (2006.01) |

(56) References Cited

U.S. PATENT DOCUMENTS

| | | | | |
|---|---|---|---|---|
| 10,036,231 | B2 * | 7/2018 | Murdoch | E21B 47/06 |
| 10,597,960 | B2 * | 3/2020 | Solem | E21B 47/00 |
| 10,619,450 | B2 * | 4/2020 | Richards | E21B 43/12 |
| 2018/0128081 | A1 * | 5/2018 | Stromquist | E21B 34/063 |
| 2020/0362693 | A1 * | 11/2020 | Ahmadian-Tehrani | E21B 47/11 |
| 2021/0115767 | A1 * | 4/2021 | Tajallipour | E21B 43/12 |
| 2021/0270107 | A1 * | 9/2021 | Mackay | E21B 34/102 |

FOREIGN PATENT DOCUMENTS

| | | | |
|---|---|---|---|
| CN | 109296348 | A | 2/2019 |
| CN | 209261535 | U | 8/2019 |
| CN | 209457919 | U | 10/2019 |

* cited by examiner

METHOD FOR CONTROLLING TOE-END SLIDING SLEEVE OF HORIZONTAL WELL BASED ON EFFICIENT DECODING COMMUNICATION

TECHNICAL FIELD

The present invention relates to the technical field of oil and gas drilling and production, particularly to a method for controlling a toe-end sliding sleeve of a horizontal well based on efficient decoding communication.

BACKGROUND ART

As an important means of increasing production, the fracturing technology is widely used in the exploitation of petroleum and natural gas. To produce more effective fracturing networks and form more effective circulation channels for oil and natural gas, the staged fracturing technology came into being. After the cementing is completed, a wellbore must undergo a pressure test for testing the wellbore sealing performance and cementing quality. However, the traditional sliding sleeve must be opened in advance for subsequent fracturing needs, so full-wellbore pressure testing operations cannot be performed.

In the existing patented technical solutions, the Chinese patent (Application No: 201220389849.9) discloses a tool that enables a fracturing ball to pass through by deforming a special material; the Chinese patent (Application No. 201820152248.3) discloses that a rupture disk is used to perform a wellbore pressure test and open a sliding sleeve; the Chinese patents (Application No. 201811289313.8 and Application No. 201821782468.0) disclose that a delayed start method is used to control a sliding sleeve; and the Chinese patent (Application No. 201921238429.9) adopts a diversion groove method. The above-mentioned patent schemes have cumbersome structures, complicated operations and low reliability.

On the other hand, at present, a pressure wave decoding method for pressure pulse communication regardless in drilling engineering or oil production engineering refers to a judgment method for performing sampling judgment of fixed thresholds or calculating an average value. The method has the advantages of simple algorithm and less amount of calculation, but has the disadvantage of being easily affected by noise. To reduce a bit error rate, it is necessary to increase the redundancy of a pressure value, which leads to an excessively long element transmission time. Therefore, how to reduce the cumbersomeness and complexity of a system for wellbore pressure test and sliding sleeve joint operation, and at the same time reduce a bit error rate of pressure pulse communication, is an urgent technical problem to be solved.

The foregoing content is only used to assist in understanding the technical solution of the present invention, and does not mean that the foregoing content is recognized as the prior art.

SUMMARY OF THE INVENTION

A main object of the present invention is to provide an intelligent pressure transmitter calibration system, which aims to solve the technical problems of complicated system of wellbore pressure test and sliding sleeve joint operation, high operation complexity, high bit error rate of pressure pulse communication, and long element transmission time in the existing solutions in the prior art.

To achieve the above object, the present invention provides a method for controlling a toe-end sliding sleeve of a horizontal well based on efficient decoding communication, comprising the following steps:

adjusting and controlling a pressure value in a wellbore according to a first preset encoding manner to form a pressure wave signal;

collecting a pressure value change signal in the wellbore, determining a reference time by using an STA/LTA method, and performing pressure value prediction to acquire a predicted pressure value signal curve;

identifying a toe-end sliding sleeve control command in the acquired pressure wave signal by using a first preset decoding manner based on the fitness between the collected pressure value signal curve and the acquired predicted pressure value signal curve; and driving the toe-end sliding sleeve to perform actions according to the toe-end sliding sleeve control command.

Preferably, the step of adjusting and controlling the pressure value in the wellbore according to the preset encoding manner to form the pressure wave signal comprises:

controlling a valve of ground pressurizing equipment to be opened or closed based on the first preset encoding manner; and converting toe-end sliding sleeve control command information into a pressure wave signal in a form of liquid pressure fluctuations by using liquid in the wellbore as a pressure transmission medium.

Preferably, the step of controlling the valve of the ground pressurizing equipment to be opened or closed based on the first preset encoding manner comprises:

building a communication control link between a control terminal and the ground pressurizing equipment;

editing/importing the toe-end sliding sleeve control command from the control terminal, and converting the toe-end sliding sleeve control command into a valve group control signal of the ground pressurizing equipment by using the first preset encoding manner; and receiving, by the ground pressurizing equipment, the valve group control signal of the control terminal to drive valve control equipment, and controlling the ground pressurizing equipment to pressurize the wellbore.

Preferably, prior to receiving, by the ground pressurizing equipment, the valve group control signal of the control terminal to drive the valve control equipment, and controlling the ground pressurizing equipment to pressurize the wellbore, further comprising the follow steps that can be implemented independently or in combination:

sending, by the control terminal, a first control signal for driving the valve control equipment to the ground pressurizing equipment to control the valve of the ground pressurizing equipment to be opened;

sending, by the control terminal, a second control signal for driving the valve control equipment to the ground pressurizing equipment to control the valve of the ground pressurizing equipment to be closed;

sending, by the control terminal, a third control signal for driving the valve control equipment to the ground pressurizing equipment to control the opening of the valve of the ground pressurizing equipment to be increased;

sending, by the control terminal, a fourth control signal for driving the valve control equipment to the ground pressurizing equipment to control the opening of the valve of the ground pressurizing equipment to be reduced.

Preferably, the step of collecting the pressure value change signal in the wellbore, determining the reference time by using the STA/LTA method, and performing pressure value prediction to acquire the predicted pressure value signal curve comprises:

monitoring a pressure value change state by the STA/LTA method; and setting a time at which a trigger threshold is monitored as the reference time, and acquiring a predicted pressure value according to a formula that a pressure value exponentially changes with the actions of the valve.

Preferably, a formula expression for monitoring the pressure value change state by the STA/LTA method is:

$$\frac{STA}{LTA} = \geq \gamma;$$

in which, $STA=\Sigma_{i=1}^{n_s}|P(i)|$; $LTA=\Sigma_{i=1}^{n_l}|P(i)|$; P(i) is a pressure value, MPa; $n_s$ is a short time window length, 1; $n_l$ is a long time window length, 1 and; $\gamma$ is a threshold, 1.

Preferably, the step of setting the time at which the trigger threshold is monitored as the reference time, and acquiring the predicted pressure value according to the formula that the pressure value exponentially changes with the actions of the valve comprises:

waking up a downhole toe-end sliding sleeve by continuously pumping a high pressure;

delimiting a waiting time range, a code element length range and a sending time range at the end of pumping the high pressure, and acquiring a stabilized high pressure value and a stabilized low pressure value through regular sampling; and sampling data during the waiting period, acquiring a time constant of pressure drop based on a fitting formula, agreeing a first code element to be 1, and acquiring a time constant of pressure rise based on the fitting formula according to the code element length, the stabilized high pressure value and the stabilized low pressure value; and calculating whether the pressure rises or drops through the acquired time constant and the current pressure value.

Preferably, the step of acquiring the predicted pressure value according to the formula that the pressure value exponentially changes with the actions of the valve comprises:

$$p_c=p_f+(p_i-p_f)e^{-t/\tau_0};$$

in which, $p_c$ is a predicted pressure value; $p_f$ is a stabilized pressure value; $p_i$ is an initial pressure value; t is a change time; and $\tau_0$ is a system coefficient obtained by fitting with a computer.

Preferably, the step of adjusting and controlling the pressure value in the wellbore according to the preset encoding manner to form the pressure wave signal comprises:

performing encoding by adopting a relative encoding technology, i.e., adopting a method of closing the value or reducing the opening of the value when a code 0 is sent, and adopting a method of opening the value or increasing the opening of the value when a code 1 is sent, or adopting an opposite way, to further generate a pressure wave signal containing the toe-end sliding sleeve control command.

Preferably, the step of acquiring the toe-end sliding sleeve control command in the pressure wave signal by using the first preset decoding manner comprises:

determining code elements sent in the pressure wave signal based on the fitness between recorded pressure value signal data and predicted pressure value signal data;

identifying information in the pressure wave signal according to a parity discrimination method; acquiring a decoded value as "1" by decoding if the calculated pressure change state is a rising state; and acquiring a decoded value as "0" by decoding if the calculated pressure change state is a drop state; and identifying the toe-end sliding sleeve control command in the acquired pressure wave signal by using the first preset decoding manner based on the acquired decoded values.

The present invention has the beneficial effects: 1, in the process of pressure relief after a wellbore pressure test ends, a ground valve is controlled to convert information into a form of liquid pressure fluctuations and transfer the converted information to a downhole sliding sleeve by taking fracturing fluid or other liquid as a medium according to a preset encoding method, thereby avoiding using cables, pipelines, or a pitching manner for information transmission, and reducing the complexity of the preliminary work of fracturing operations; 2, the sliding sleeve disclosed by the present invention comprises a pressure detection unit, a decoding unit and an execution unit, wherein the pressure detection unit is configured to detect pressure fluctuations in a wellbore, and the decoding unit is configured to decode address information and action information contained in a pressure wave signal, match an address in the pressure wave with a local address and send an instruction of the operation information in the pressure wave to the action execution unit after the match is successful, such that the operation information contained in the pressure wave is analyzed and reflected in the sliding sleeve; 3, the action execution unit in the sliding sleeve of the present invention includes a built-in hydraulic or mechanical motion system (including but not limited to: being pushed by a hydraulic pressure or a screw rod) and an independent power supply, such that the movement of the sliding sleeve is easier to operate, and it is also convenient for construction personnel to independently control a plurality of sliding sleeves; 4, the change in opening of a control valve is automatically controlled according to the preset encoding method to generate a pressure wave sequence, and the address information and the operation information including in the information carried by the pressure wave are then transmitted to the downhole sliding sleeve, so that the construction personnel can accurately control the movement and status of each sliding sleeve remotely; and 5, the present invention proposes an efficient decoding method in a noisy environment, which is different from traditional fixed threshold sampling judgment or average value judgment, and can reduce the influence of noise on pressure communication of the downhole sliding sleeve in either drilling engineering or oil production engineering. The method aims to solve the technical problems of complicated system of wellbore pressure test and sliding sleeve joint operation, high operation complexity, high error rate of pressure pulse communication, and long element transmission time in the existing solutions in the prior art.

BRIEF DESCRIPTION OF THE DRAWINGS

To describe the embodiments of the present invention or the technical solutions in the prior art more clearly, the following briefly introduces the accompanying drawings required for describing the embodiments or the descriptions in the prior art. Apparently, the accompanying drawings in the following description show merely some embodiments of the present invention, and a person of ordinary skill in the art may still derive other drawings from these accompanying drawings without creative efforts.

The achievement of the objects, functional characteristics and advantages of the present invention will be further described in conjunction with the embodiments and with reference to the accompanying drawings.

DETAILED DESCRIPTION

The specific embodiments described here are only used to explain the present invention, but not used to limit the present invention.

The technical solutions in the embodiments of the present invention will be described clearly and completely in conjunction with the accompanying drawings in the embodiments of the present invention. Apparently, the described embodiments are merely some embodiments, rather than all embodiments, of the present invention. Based on the embodiments of the present invention, all other embodiments derived by a person of ordinary skill in the art without creative efforts shall fall within the protection scope of the present invention.

Figure 1:
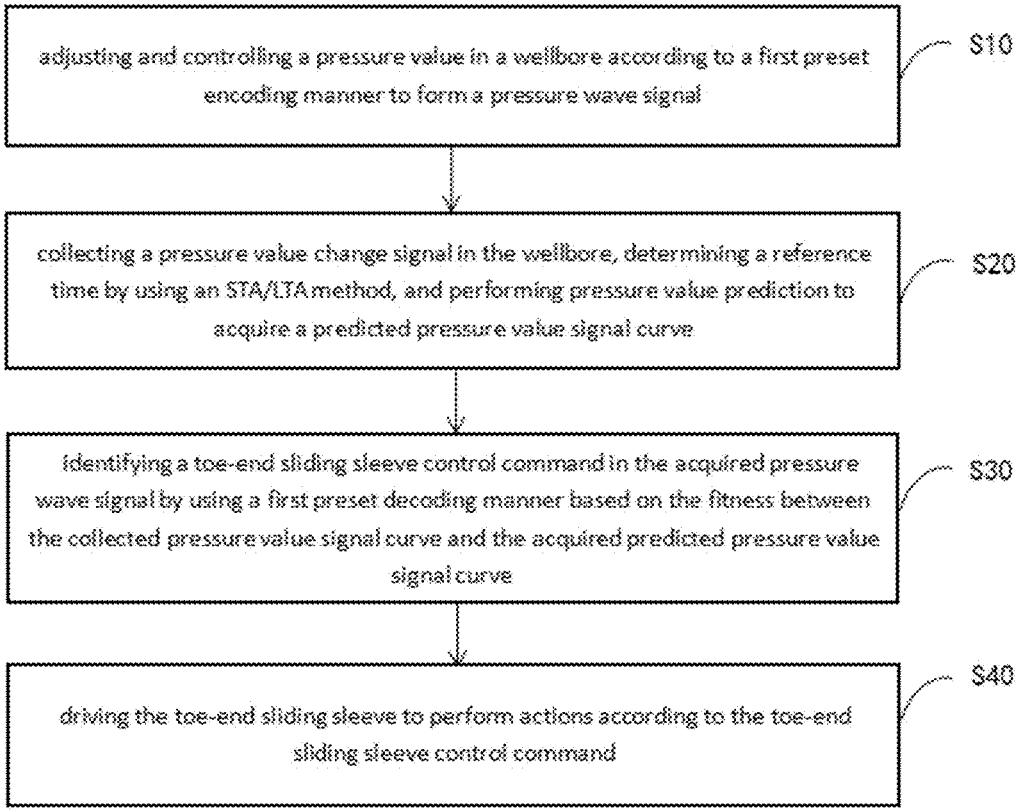
FIG. 1 is a schematic diagram of method steps in the present invention.

The present invention provides an embodiment. Referring to FIG. 1, FIG. 1 is a schematic diagram of the steps of a method for controlling a toe-end sliding sleeve of a horizontal well based on efficient decoding communication as provided by the present invention.

As shown in FIG. 1, in this embodiment, a method for controlling a toe-end sliding sleeve of a horizontal well based on efficient decoding communication, comprising the following steps:

S10: adjusting and controlling a pressure value in a wellbore according to a first preset encoding manner to form a pressure wave signal;

S20: collecting a pressure value change signal in the wellbore, determining a reference time by using an STA/LTA method, and performing pressure value prediction to acquire a predicted pressure value signal curve;

S30: identifying a toe-end sliding sleeve control command in the acquired pressure wave signal by using a first preset decoding manner based on the fitness between the collected pressure value signal curve and the acquired predicted pressure value signal curve; and S40: driving the toe-end sliding sleeve to perform actions according to the toe-end sliding sleeve control command.

Figure 2:
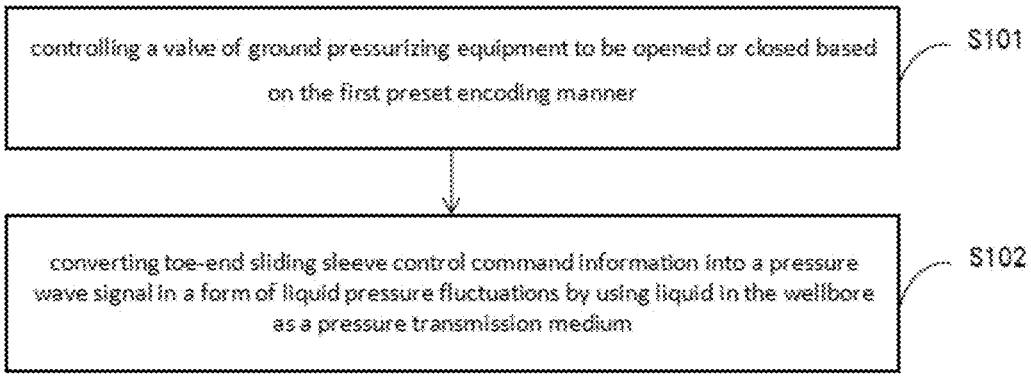
FIG. 2 is a schematic diagram of a step of adjusting and controlling a pressure value in a wellbore in the present invention.

In the preferred implementation process, as shown in FIG. 2, the step of adjusting and controlling the pressure value in the wellbore according to the preset encoding manner to form the pressure wave signal comprises:

S101: controlling a valve of ground pressurizing equipment to be opened or closed based on the first preset encoding manner; and S102: converting toe-end sliding sleeve control command information into a pressure wave signal in a form of liquid pressure fluctuations by using liquid in the wellbore as a pressure transmission medium.

Figure 3:
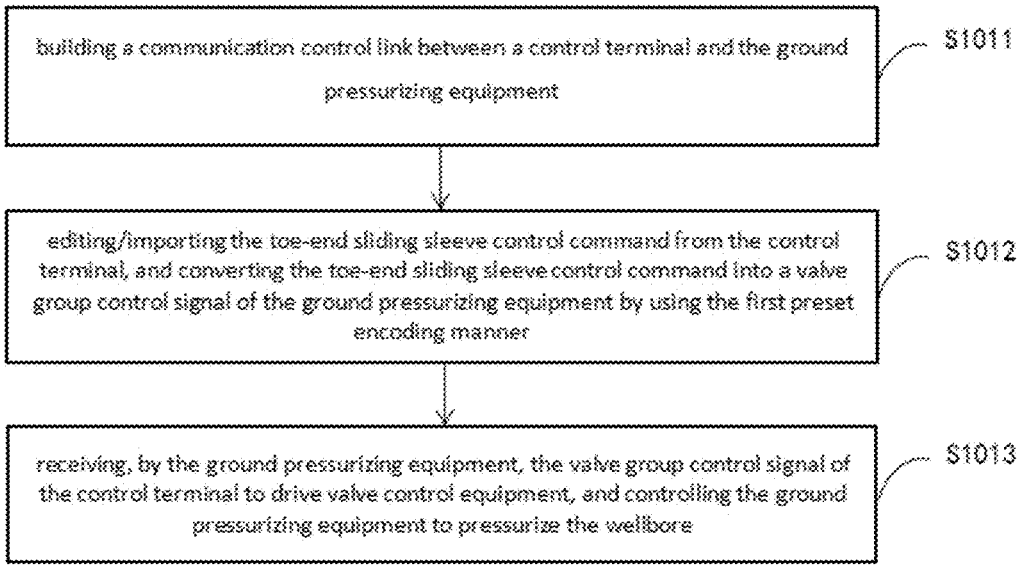
FIG. 3 is a schematic diagram of a step of controlling a value of ground pressurizing equipment to be opened or closed in the present invention.

In the preferred implementation process, as shown in FIG. 3, the step of controlling the valve of the ground pressurizing equipment to be opened or closed based on the first preset encoding manner comprises:

S1011: building a communication control link between a control terminal and the ground pressurizing equipment;

S1012: editing/importing the toe-end sliding sleeve control command from the control terminal, and converting the toe-end sliding sleeve control command into a valve group control signal of the ground pressurizing equipment by using the first preset encoding manner; and S1013: receiving, by the ground pressurizing equipment, the valve group control signal of the control terminal to drive valve control equipment, and controlling the ground pressurizing equipment to pressurize the wellbore.

Figure 4:
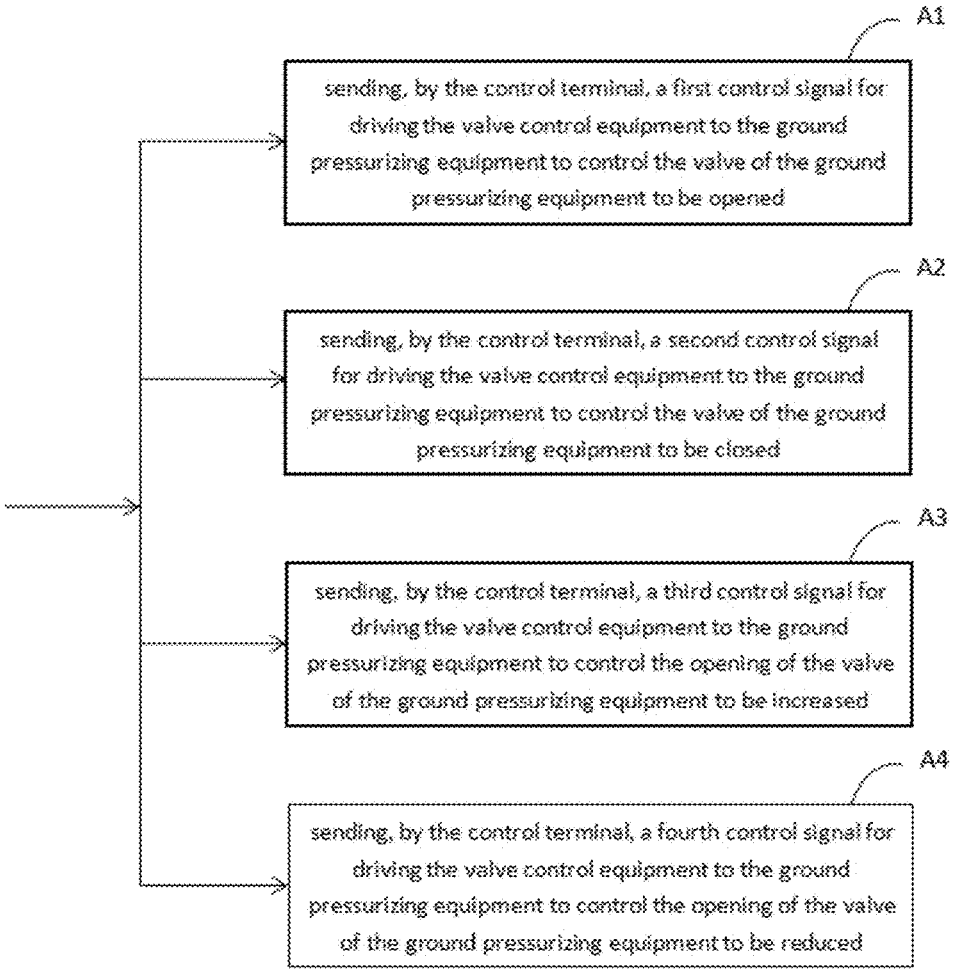
FIG. 4 is a schematic diagram of a step of controlling the valve of the ground pressurizing equipment in the present invention.

In the preferred implementation process, as shown in FIG. 4, prior to receiving, by the ground pressurizing equipment, the valve group control signal of the control terminal to drive the valve control equipment, and controlling the ground pressurizing equipment to pressurize the wellbore, further comprising the follow steps that can be implemented independently or in combination:

A1: sending, by the control terminal, a first control signal for driving the valve control equipment to the ground pressurizing equipment to control the valve of the ground pressurizing equipment to be opened;

A2: sending, by the control terminal, a second control signal for driving the valve control equipment to the ground pressurizing equipment to control the valve of the ground pressurizing equipment to be closed;

A3: sending, by the control terminal, a third control signal for driving the valve control equipment to the ground pressurizing equipment to control the opening of the valve of the ground pressurizing equipment to be increased;

A4: sending, by the control terminal, a fourth control signal for driving the valve control equipment to the ground pressurizing equipment to control the opening of the valve of the ground pressurizing equipment to be reduced.

Figure 5:
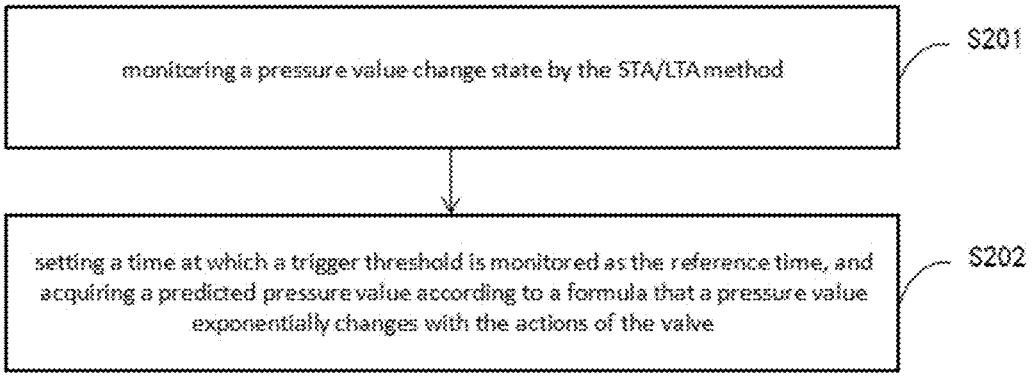
FIG. 5 is a schematic diagram of a step of acquiring a predicted pressure value signal curve in the present invention.

In the preferred implementation process, as shown in FIG. 5, the step of collecting the pressure value change signal in the wellbore, determining the reference time by using the STA/LTA method, and performing pressure value prediction to acquire the predicted pressure value signal curve comprises:

S201: monitoring a pressure value change state by the STA/LTA method; and

S202: setting a time at which a trigger threshold is monitored as the reference time, and acquiring a predicted pressure value according to a formula that a pressure value exponentially changes with the actions of the valve.

In the preferred implementation process, a formula expression for monitoring the pressure value change state by the STA/LTA method is:

$$\frac{STA}{LTA} = \geq \gamma;$$

in which, $STA=\Sigma_{i=1}^{n_s}|P(i)|$; $LTA=\Sigma_{i=1}^{n_l}|P(i)|$; P(i) is a pressure value, MPa; $n_s$ is a short time window length, 1; $n_1$ is a long time window length, 1 and; $\gamma$ is a threshold, 1.

Figure 6:
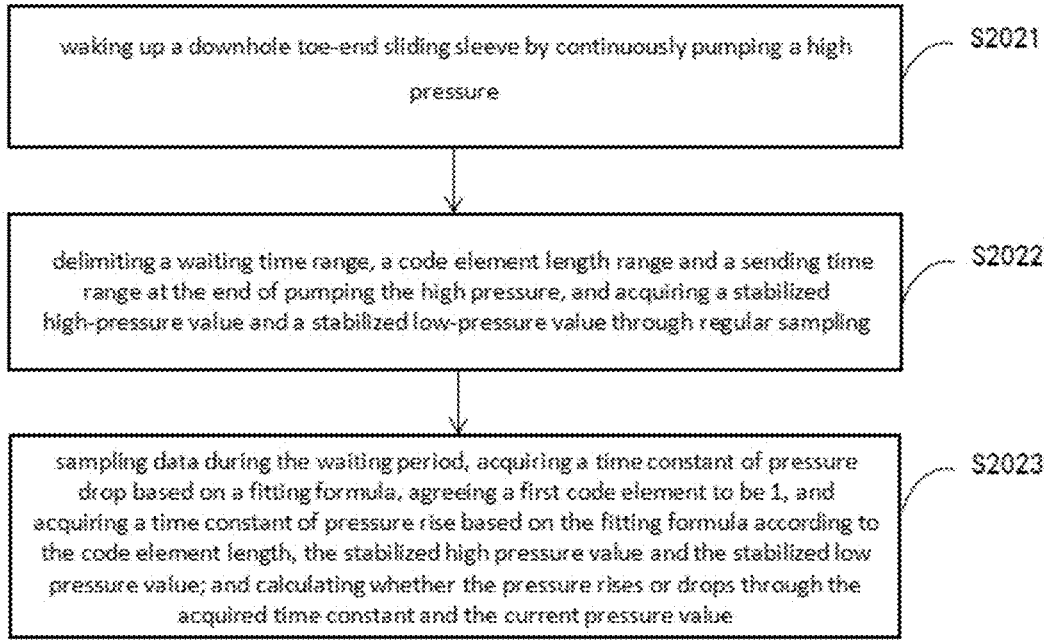
FIG. 6 is a schematic diagram of a step of acquiring a predicted pressure value in the present invention.

In the preferred implementation process, as shown in FIG. 6, the step of setting the time at which the trigger threshold is monitored as the reference time, and acquiring the predicted pressure value according to the formula that the pressure value exponentially changes with the actions of the valve comprises:

S2021: waking up a downhole toe-end sliding sleeve by continuously pumping a high pressure;

S2022: delimiting a waiting time range, a code element length range and a sending time range at the end of pumping the high pressure, and acquiring a stabilized high-pressure value and a stabilized low-pressure value through regular sampling; and S2023: sampling data during the waiting period, acquiring a time constant of pressure drop based on a fitting formula, agreeing a first code element to be 1, and acquiring a time constant of pressure rise based on the fitting formula according to the code element length, the stabilized high pressure value and the stabilized low pressure value; and calculating whether the pressure rises or drops through the acquired time constant and the current pressure value.

In the preferred implementation process, the step of acquiring the predicted pressure value according to the formula that the pressure value exponentially changes with the actions of the valve comprises:

$$p_c=p_f+(p_i-p_f)e^{-t/\tau_0};$$

in which, $p_c$ is a predicted pressure value; $p_f$ is a stabilized pressure value; $p_i$ is an initial pressure value; t is a change time; and $\tau_0$ is a system coefficient obtained by fitting with a computer.

In the preferred implementation process, the step of adjusting and controlling the pressure value in the wellbore according to the preset encoding manner to form the pressure wave signal comprises:

performing encoding by adopting a relative encoding technology, i.e., adopting a method of closing the value or reducing the opening of the value when a code 0 is sent, and adopting a method of opening the value or increasing the opening of the value when a code 1 is sent, or adopting an opposite way, to further generate a pressure wave signal containing the toe-end sliding sleeve control command.

Figure 7:
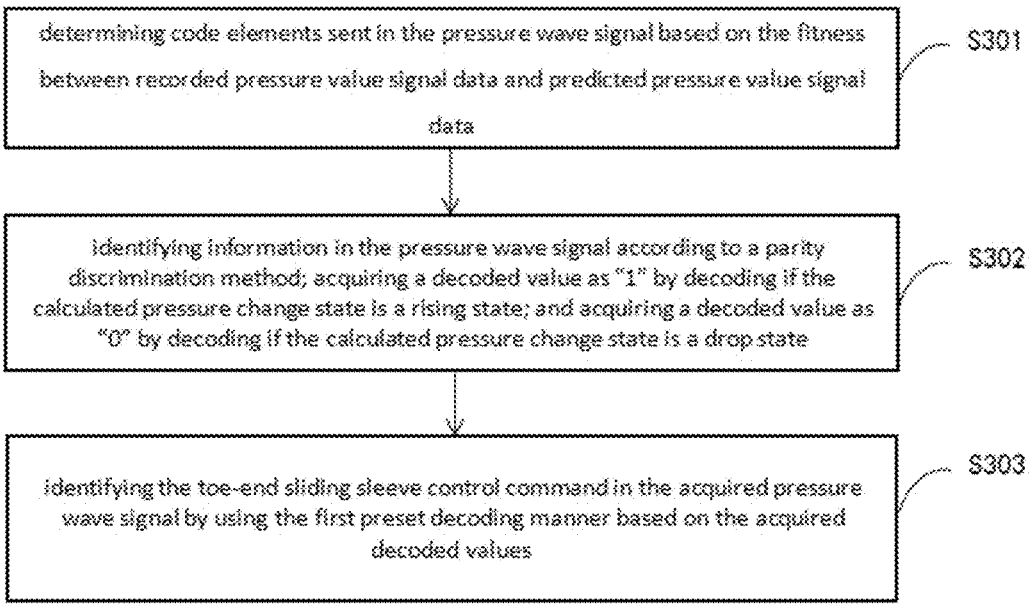
FIG. 7 is a schematic diagram of a step of acquiring a toe-end sliding sleeve control command in a pressure wave signal in the present invention.

In the preferred implementation process, as shown in FIG. 7, the step of acquiring the toe-end sliding sleeve control command in the pressure wave signal by using the first preset decoding manner comprises:

S301: determining code elements sent in the pressure wave signal based on the fitness between recorded pressure value signal data and predicted pressure value signal data;

S302: identifying information in the pressure wave signal according to a parity discrimination method; acquiring a decoded value as "1" by decoding if the calculated pressure change state is a rising state; and acquiring a decoded value as "0" by decoding if the calculated pressure change state is a drop state; and S303: identifying the toe-end sliding sleeve control command in the acquired pressure wave signal by using the first preset decoding manner based on the acquired decoded values.

Figure 8:
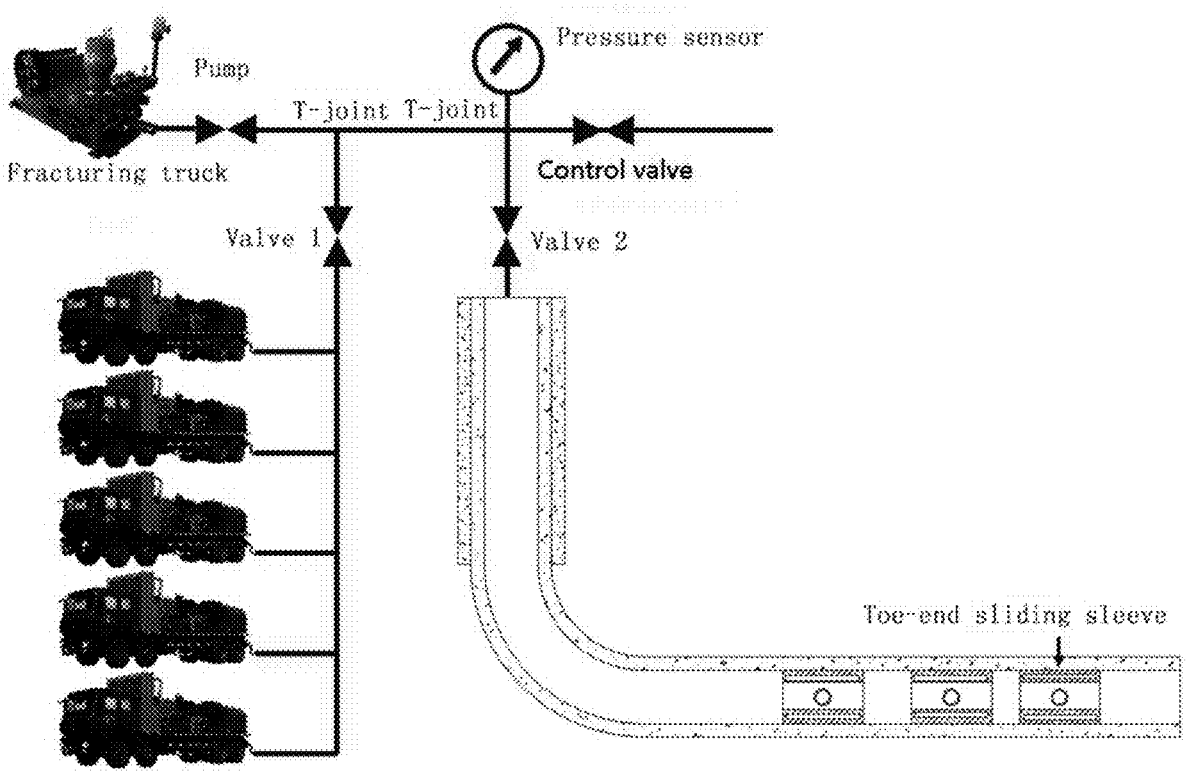
FIG. 8 is a diagram of the working principle of equipment of a method for controlling a toe-end sliding sleeve of a horizontal well in the present invention.
Figure 9:
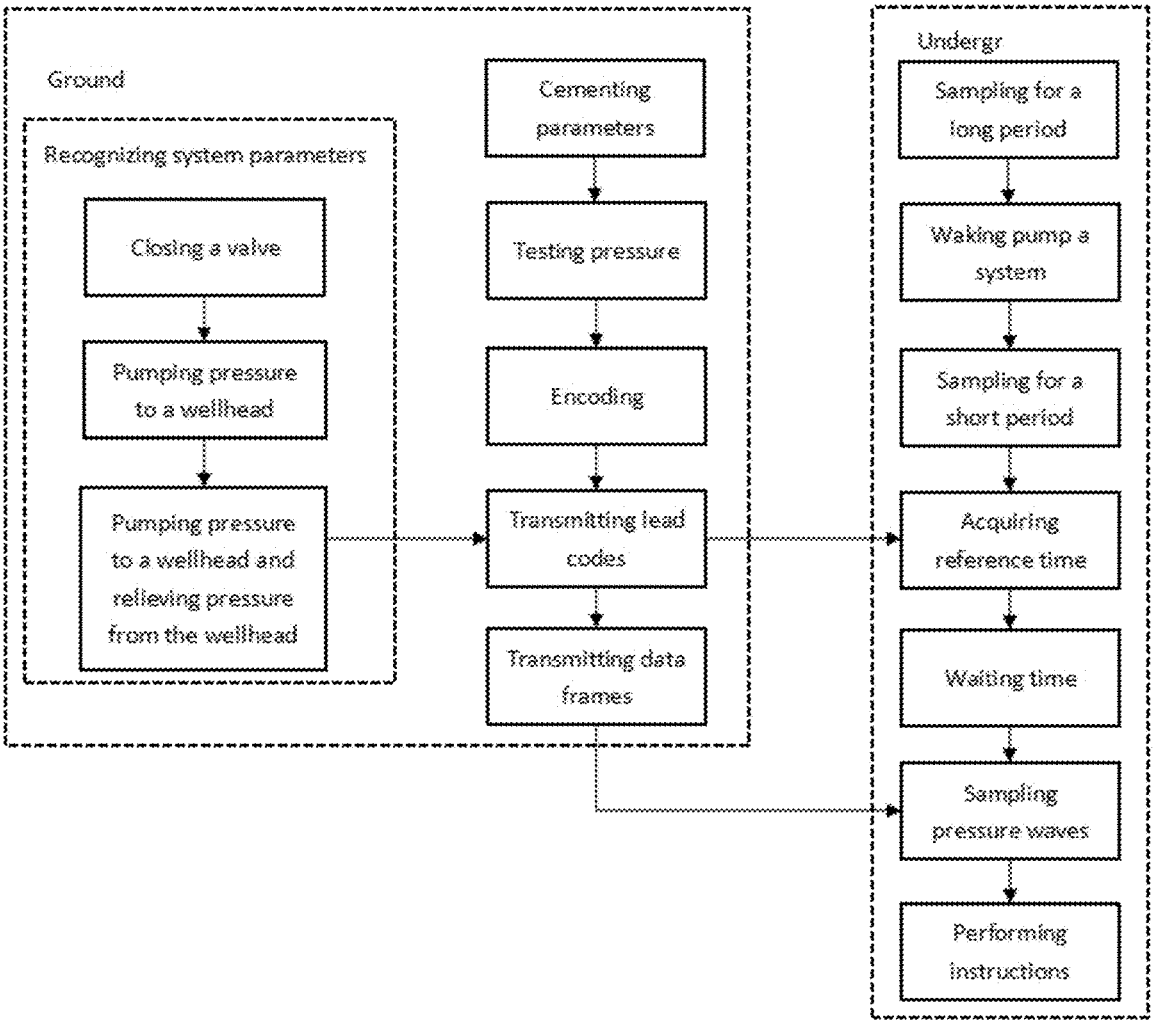
FIG. 9 is an overall control flow chart of a method for controlling a toe-end sliding sleeve of a horizontal well in the present invention.

In another feasible embodiment, as shown in FIG. 8 and FIG. 9, the specific implementation method is as follows:

a sliding sleeve which is initially closed is lowered into a well along with a casing and a cementing operation is then carried out. Clean water is injected to a position of an impact seat instead of a cementing rubber plug, and the cementing operation ends. Before the fracturing operation, a fracturing truck is used to carry out the pressure test operation of the whole wellbore. After completion, pressure waves are launched into the wellbore by enabling the ground pressure to rise and drop.

According to the established encoding method, ground equipment is controlled to enable the pressure at a wellhead to rise or drop to produce a pressure change in the wellbore and transmit the pressure change to the bottom of the well with a clean water medium. A sliding sleeve control unit is woken up, regular pressure codes are then sent to activate a motor, and a pressure transmission hole is exposed.

High-pressure liquid in the wellbore enters a sliding sleeve drive chamber through the pressure transmission hole, and pushes a piston in the sliding sleeve to move, and the sliding sleeve is then opened to establish a first fracturing channel.

The present embodiment proposes an efficient decoding method in a noisy environment, which is different from traditional fixed threshold sampling judgment or average value judgment. According to the method, after the control valve acts, a wellbore pressure value exponentially changes. If the structure of the system does not change (a leakage coefficient remains the same or there is no new leakage point), system constants for pressure rise and pressure drop, a steady-state low pressure value and a steady-state high pressure value will not change.

Figure 10:
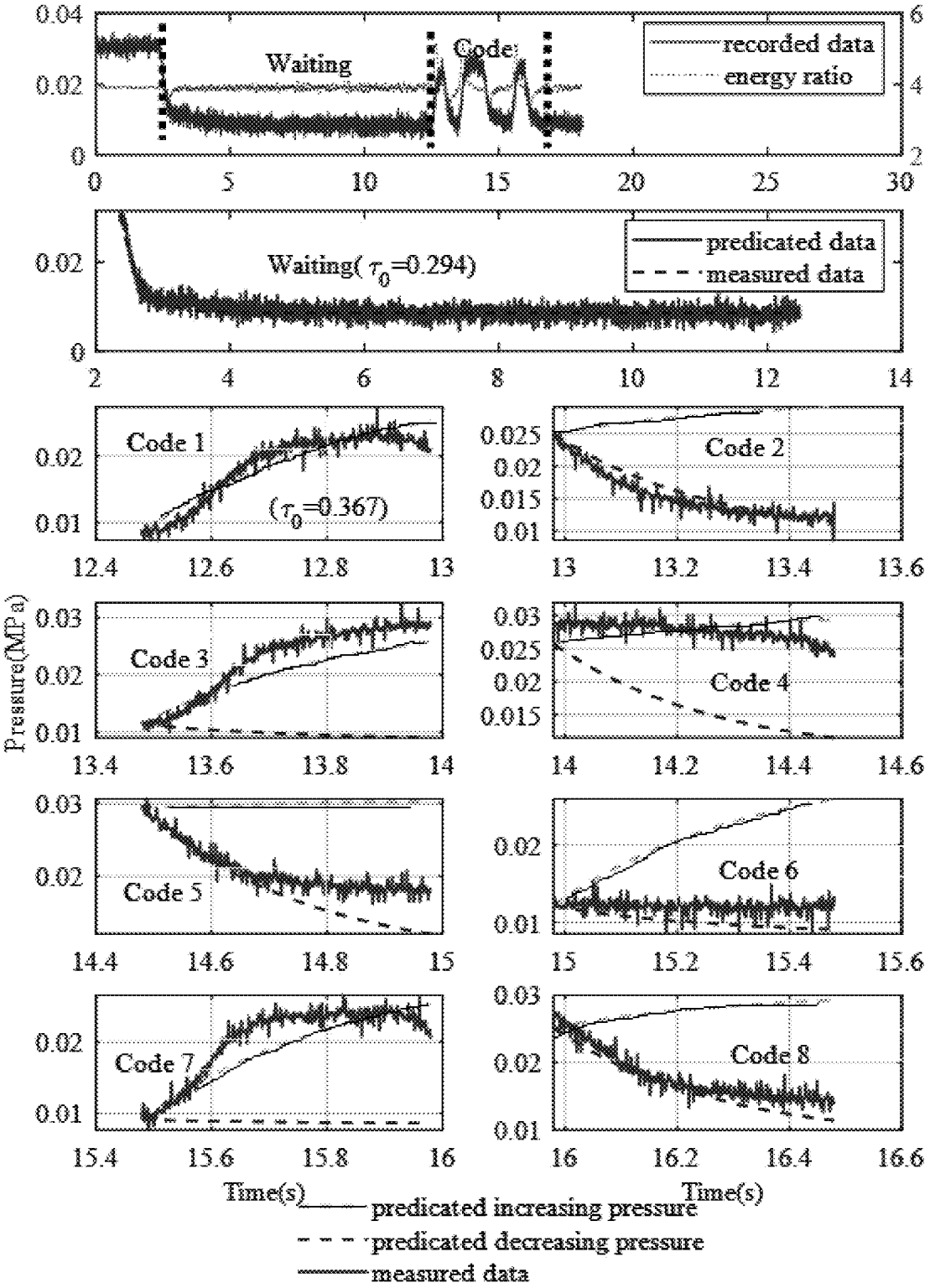
FIG. 10 is a schematic diagram of an operating state and pressure change of the sliding sleeve in the method for controlling the toe-end sliding sleeve of the horizontal well in the present invention.

In the preferred implementation process, as shown in FIG. 10, the downhole sliding sleeve is woken up by continuously pumping a high pressure, followed by a waiting time, a code element length and a sending time. The above times are preset into the sliding sleeve, and the pressure change of the wellbore, including high pressure and low pressure, is acquired by a timing sampling method.

Data are sampled during the waiting period, and a time constant of pressure drop is acquired based on a fitting formula; and when a first code element is agreed to be 1, a time constant of pressure rise is acquired based on the fitting formula according to the code element length, the high-pressure value and the low-pressure value.

Figure 11:
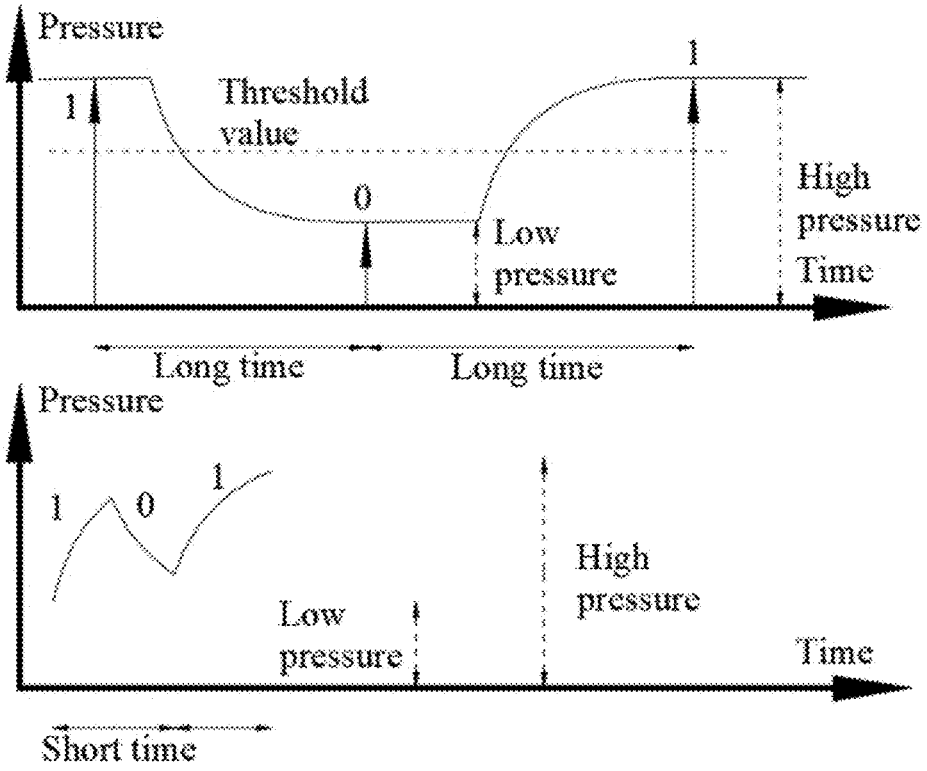
FIG. 11 is a schematic diagram of a step of determining code elements in a pressure wave signal in the present invention.

As shown in FIG. 11, the changes in pressure rise and pressure drop can be inferred if the current pressure value is known. The code elements sent in the pressure wave signal can be judged according to the fitness (such as a root mean square) between recorded pressure data (a pressure value or pressure variance value) and predicted data (a predicted pressure value or a predicted pressure variance value).

After an identification method for the code elements is determined, a calculation method for a start time needs to be determined. At present, most downhole tools use a dormant-wake method to reduce power consumption. In the dormant state, the system is awakened for a fixed period, and then continues to enter the dormant state after data are collected and calculated.

When the system needs to enter a working state, at present, a continuous high-pressure wake-up system is often set into the ground and then enters the working state to increase a pressure collection frequency. Then, the pressure change is determined based on a STA/LTA method to determine a reference time. The specific expression of the method is as follows:

$$STA = \sum_{i=1}^{n_s} |P(i)|$$

$$LTA = \sum_{i=1}^{n_l} |P(i)|$$

$$\frac{STA}{LTA} = \geq \gamma$$

in which: P(i) is a pressure value, MPa;

$n_s^{n_s}$ is a short-time window length, 1;

$n_l$ is a long-time window length, 1; and $\gamma^{\gamma}$ is a threshold, 1.

When a time at which a trigger threshold is monitored by using the STA/LTA method is taken as the reference time, the data in the waiting time and the pressure value of each code element length are extracted according to a predetermined time; a pressure change is predicted according to the stabilized high pressure, the stabilized low pressure, a pressure rise constant and a pressure drop constant; the pressure signals are matched according to the recorded values to determine a transmitted code element value; and the information in the pressure wave signal is identified according to a parity discrimination method.

In this embodiment, in the process of pressure relief after a wellbore pressure test ends, a ground valve is controlled to convert information into a form of liquid pressure fluctuations and transfer the converted information to a downhole sliding sleeve by taking fracturing fluid or other liquid as a medium according to a preset encoding method, thereby avoiding using cables, pipelines, or a pitching manner for information transmission, and reducing the complexity of the preliminary work of fracturing operations;

It should be noted that, the sliding sleeve disclosed by the embodiment comprises a pressure detection unit, a decoding unit and an execution unit, wherein the pressure detection unit is configured to detect pressure fluctuations in a wellbore, and the decoding unit is configured to decode address information and action information contained in a pressure wave signal, match an address in the pressure wave with a local address and send an instruction of the operation information in the pressure wave to the action execution unit after the match is successful, such that the operation information contained in the pressure wave is analyzed and reflected in the sliding sleeve;

It should be noted that, the action execution unit in the sliding sleeve of the embodiment includes a built-in hydraulic or mechanical motion system (including but not limited to: being pushed by a hydraulic pressure or a screw rod) and an independent power supply, such that the movement of the sliding sleeve is easier to operate, and it is also convenient for construction personnel to independently control a plurality of sliding sleeves;

It should be noted that, the change in opening of a control valve is automatically controlled according to the preset encoding method to generate a pressure wave sequence, and the address information and the operation information including in the information carried by the pressure wave are then transmitted to the downhole sliding sleeve, so that the construction personnel can accurately control the movement and status of each sliding sleeve remotely; and It should be noted that, the embodiment proposes an efficient decoding method in a noisy environment, which is different from traditional fixed threshold sampling judgment or average value judgment, and can reduce the influence of noise on pressure communication of the downhole sliding sleeve in either drilling engineering or oil production engineering. The method aims to solve the technical problems of complicated system of wellbore pressure test and sliding sleeve joint operation, high operation complexity, high error rate of pressure pulse communication, and long element transmission time in the existing solutions in the prior art.

The disclosed method, system and modules of the present invention can be achieved by other means. For example, the embodiments described above are merely schematic. For example, the partitioning of the modules can be a logical functional partitioning. There may be other partitioning modes during actual implementation. For example, multiple modules or components can be combined or integrated into another system, or some features can be ignored or not executed. In addition, mutual coupling or direct coupling or communication connection that is shown or discussed can be indirect coupling or communication connection through some interfaces, systems or modules, and can be in electrical, mechanical or other forms.

The modules described as separate components may or may not be physically separated, and the components for unit display may or may not be physical units, that is, may be in one place or distributed on a plurality of network modules. Part of or all the modules can be selected according to actual needs to achieve the object of the solutions of the embodiments.

In addition, all functional modules in the embodiments of the present invention can be integrated into one processing module. Or, each module exists physically independently. Or, two or more modules can be integrated into one unit.

The above description merely describes preferable implementations of the present invention. The present invention is not limited to the forms disclosed herein, and should not be regarded as the exclusion of other embodiments, but can be used in various other combinations, modifications and environments, and can be modified through the above teachings or technology or knowledge in related fields within the scope of the concept described herein. However, modifications and changes made by those skilled in the art should fall within the protection scope of the appended claims of the present invention, without departing the spirit and scope of the present invention.

The invention claimed is:

1. A method for controlling a toe-end sliding sleeve of a horizontal well based on efficient decoding communication, comprising the following steps:

adjusting and controlling a pressure value in a wellbore according to a first preset encoding manner to form a pressure wave signal, said adjusting and controlling comprising controlling a valve of ground pressurizing equipment to be opened or closed based on the first preset encoding manner, said controlling the valve of ground pressurizing equipment to be opened or closed comprising:

building a communication control link between a control terminal and the ground pressurizing equipment;

editing/importing the toe-end sliding sleeve control command from the control terminal, and converting the toe-end sliding sleeve control command into a valve group control signal of the ground pressurizing equipment by using the first preset encoding manner; and receiving, by the ground pressurizing equipment, the valve group control signal of the control terminal to drive valve control equipment, and controlling the ground pressurizing equipment to pressurize the wellbore;

collecting a pressure value change signal in the wellbore, determining a reference time by using a short term average/long term average (STA/LTA) method, and performing pressure value prediction to acquire a predicted pressure value signal curve;

identifying a toe-end sliding sleeve control command in the acquired pressure wave signal by using a first preset decoding manner based on a fitness between a collected pressure value signal curve and the acquired predicted pressure value signal curve; and driving the toe-end sliding sleeve to perform actions according to the toe-end sliding sleeve control command.

2. The method for controlling the toe-end sliding sleeve of the horizontal well based on efficient decoding communication according to claim 1, wherein the step of adjusting and controlling the pressure value in the wellbore according to the preset encoding manner to form the pressure wave signal further comprises:

converting toe-end sliding sleeve control command information into a pressure wave signal in a form of liquid pressure fluctuations by using liquid in the wellbore as a pressure transmission medium.

3. The method for controlling the toe-end sliding sleeve of the horizontal well based on efficient decoding communication according to claim 1, wherein prior to receiving, by the ground pressurizing equipment, the valve group control signal of the control terminal to drive the valve control equipment, and controlling the ground pressurizing equipment to pressurize the wellbore, further comprising the follow steps that can be implemented independently or in combination:

sending, by the control terminal, a first control signal for driving the valve control equipment to the ground pressurizing equipment to control the valve of the ground pressurizing equipment to be opened;

sending, by the control terminal, a second control signal for driving the valve control equipment to the ground pressurizing equipment to control the valve of the ground pressurizing equipment to be closed;

sending, by the control terminal, a third control signal for driving the valve control equipment to the ground pressurizing equipment to control the opening of the valve of the ground pressurizing equipment to be increased;

sending, by the control terminal, a fourth control signal for driving the valve control equipment to the ground pressurizing equipment to control the opening of the valve of the ground pressurizing equipment to be reduced.

4. The method for controlling the toe-end sliding sleeve of the horizontal well based on efficient decoding communication according to claim 1, wherein the step of collecting the pressure value change signal in the wellbore, determining the reference time by using the STA/LTA method, and performing pressure value prediction to acquire the predicted pressure value signal curve comprises:

monitoring a pressure value change state by the STA/LTA method; and setting a time at which a trigger threshold is monitored as the reference time, and acquiring a predicted pressure value according to a formula that a pressure value exponentially changes with the actions of a valve.

5. The method for controlling the toe-end sliding sleeve of the horizontal well based on efficient decoding communication according to claim 4, wherein a formula expression for monitoring the pressure value change state by the STA/LTA method is:

$$\frac{STA}{LTA} = \geq \gamma;$$

in which, $STA=\Sigma_{i=1}^{n_s}|P(i)|$; $LTA=\Sigma_{i=1}^{n_l}|P(i)|$; P(i) is a pressure value, MPa; $n_s$ is a short time window length, 1; $n_l$ is a long time window length, 1 and; $\gamma$ is a threshold, 1.

6. The method for controlling the toe-end sliding sleeve of the horizontal well based on efficient decoding communication according to claim 4, wherein the step of setting the time at which the trigger threshold is monitored as the reference time, and acquiring the predicted pressure value according to the formula that the pressure value exponentially changes with the actions of the valve comprises:

waking up a downhole toe-end sliding sleeve by continuously pumping a high pressure;

delimiting a waiting time range, a code element length range and a sending time range at the end of pumping the high pressure, and acquiring a stabilized high pressure value and a stabilized low pressure value through regular sampling; and sampling data during the waiting period, acquiring a time constant of pressure drop based on a fitting formula, agreeing a first code element to be 1, and acquiring a time constant of pressure rise based on the fitting formula according to the code element length, the stabilized high pressure value and the stabilized low pressure value; and calculating whether the pressure rises or drops through the acquired time constant and the current pressure value.

7. The method for controlling the toe-end sliding sleeve of the horizontal well based on efficient decoding communication according to claim 5, wherein the step of acquiring the predicted pressure value according to the formula that the pressure value exponentially changes with the actions of the valve comprises:

$$p_c=p_f+(p_i-p_f)e^{-t/\tau_0};$$

in which, $p_c$ is a predicted pressure value; $p_f$ is a stabilized pressure value; $p_i$ is an initial pressure value; t is a change time; and $\tau_0$ is a system coefficient obtained by fitting with a computer.

8. The method for controlling the toe-end sliding sleeve of the horizontal well based on efficient decoding communication according to claim 1, wherein the step of adjusting and controlling the pressure value in the wellbore according to the preset encoding manner to form the pressure wave signal comprises:

performing encoding by adopting a relative encoding technology, i.e., adopting a method of closing the valve or reducing the opening of the valve when a code 0 is sent, and adopting a method of opening the valve or increasing the opening of the valve when a code 1 is sent, or adopting an opposite way, to further generate a pressure wave signal containing the toe-end sliding sleeve control command.

9. The method for controlling the toe-end sliding sleeve of the horizontal well based on efficient decoding communication according to claim 1, wherein the step of acquiring the toe-end sliding sleeve control command in the pressure wave signal by using the first preset decoding manner comprises:

determining code elements sent in the pressure wave signal based on the fitness between recorded pressure value signal data and predicted pressure value signal data;

identifying information in the pressure wave signal according to a parity discrimination method; acquiring a decoded value as "1" by decoding if the calculated pressure change state is a rising state; and acquiring a decoded value as "0" by decoding if the calculated pressure change state is a drop state; and identifying the toe-end sliding sleeve control command in the acquired pressure wave signal by using the first preset decoding manner based on the acquired decoded values.

* * * * *